United States Patent [19]

Scheer

[11] Patent Number: 4,590,545

[45] Date of Patent: May 20, 1986

[54] LIGHT FIXTURE

[76] Inventor: Raymond D. Scheer, 9711 N. Hollybrook Lake Dr., Pembroke Pines, Fla. 33025

[21] Appl. No.: 645,244

[22] Filed: Aug. 29, 1984

[51] Int. Cl.[4] ..... F21P 1/02

[52] U.S. Cl. ..... 362/392; 362/810

[58] Field of Search ..... 362/392, 405, 406, 447, 362/810

[56] References Cited

U.S. PATENT DOCUMENTS

| | | | |
|---|---|---|---|
| 985,234 | 2/1911 | Wagner | 362/810 |
| 1,159,042 | 11/1915 | Kahns | 362/392 |
| 1,417,330 | 5/1922 | Kahns | 362/392 |
| 1,417,532 | 5/1922 | Klein | 362/392 |
| 1,506,063 | 8/1924 | Herskowitz | 362/392 |
| 1,955,469 | 4/1934 | Panczner | 362/382 |
| 1,962,421 | 6/1934 | Boye | 362/382 |
| 2,026,756 | 1/1936 | Surface | 362/408 |
| 2,278,433 | 4/1942 | Etting | 362/405 |
| 2,804,542 | 8/1957 | Siegel | 362/405 |
| 3,387,129 | 6/1968 | Weber et al. | 362/392 |
| 3,719,820 | 3/1973 | Yarmark | 362/382 |
| 4,034,216 | 7/1977 | Webster et al. | 362/405 |

FOREIGN PATENT DOCUMENTS

| | | | |
|---|---|---|---|
| 158787 | 2/1921 | United Kingdom | 362/392 |

*Primary Examiner*—Magdalen Y. C. Moy

*Attorney, Agent, or Firm*—Steele, Gould & Fried

[57] ABSTRACT

An electric light fixture of a type simulating a candle holder has a bobeche and candle cup which may be affixed or removed over an electrical socket without removing the socket and without risk of damage to electric wires. The structure facilitates assembly and storage and allows interchangeable choice of bobeche and candle cup designs. A connecting flange mounted immediately adjacent the electric socket support has an external threaded portion of a diameter larger than the bulb socket. At least one of the bobeche and candle cup has a split flange forming the female thread for engaging connecting flange.

6 Claims, 6 Drawing Figures

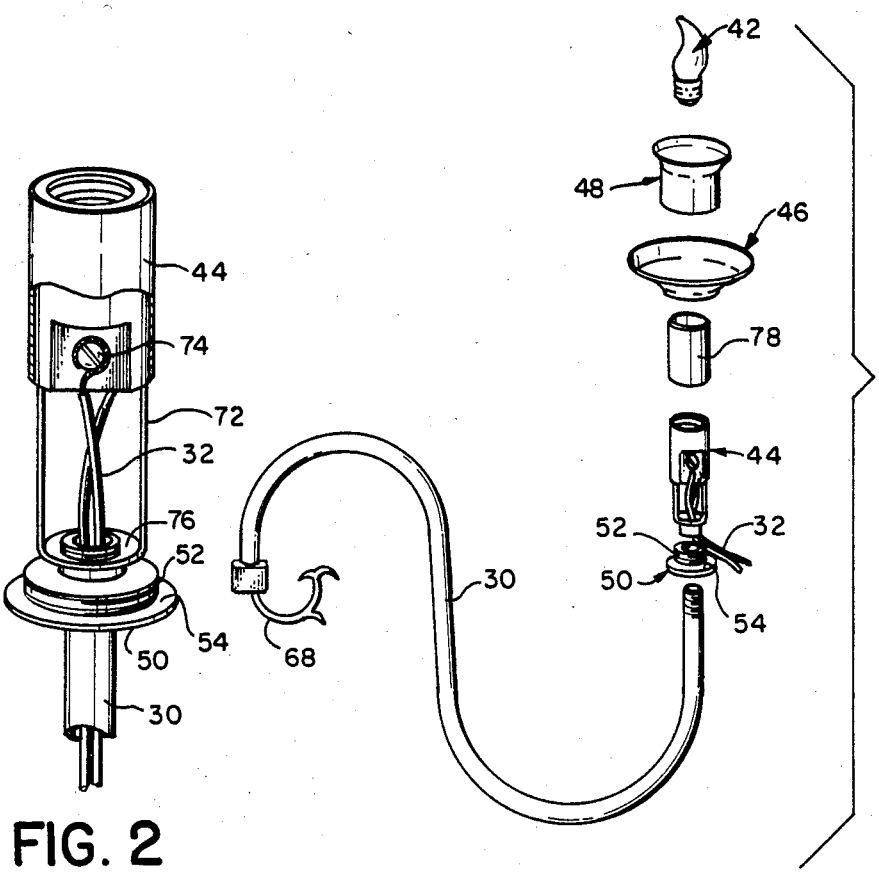
FIG. 1
FIG. 2
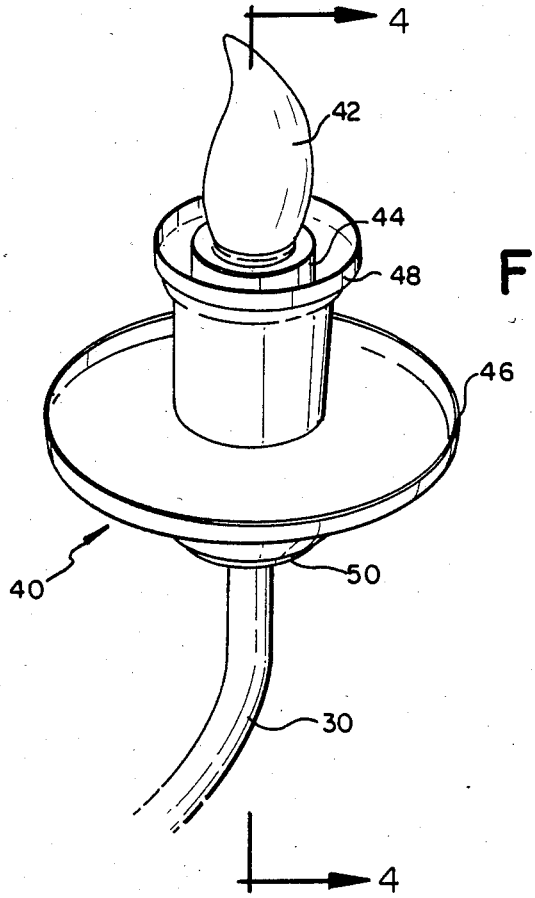
FIG. 3

LIGHT FIXTURE

BACKGROUND OF THE INVENTION

1. Field of the Invention

This invention relates to the field of electric light fixtures, and in particular to light fixtures having a removable bobeche and candle cup intended to reflect traditional candle holder designs using electrical bulbs and sockets.

2. Prior Art

The prior art includes a number of designs in which a bulb socket having a cylindrical shape suggesting a candle, is mounted on a substantially-cylindrical short cup simulating a candle cup. These are stacked on a disc or saucer-shaped member simulating the traditional bobeche. The structure is intended to simulate traditional wax candles and holders in which the candle cup supports the wax candle by enclosing its base and the bobeche catches drips of wax.

The prior art has developed a standard structure for simulating candle holders in electric fixtures supporting light bulbs. A bulb, which may have an arcuate flame-like shape is placed in an electrical socket having a right cylindrical appearance reminiscent of a length of candle. The socket is then centrally mounted in a candle cup and bobeche stacked one on the other. The candle cup and bobeche, without departing from traditional features, may vary in height, width, angle, or configuration, but the bobeche always extends edgewise outwards beyond the remainder of the construction.

Electrical fittings according to the prior art are attached to a threaded free end of a hollow metal tube, the tube carrying wires connecting a source of electric power to the bulb socket. Almost invariably, the prior art has employed an electrical socket which must be twisted to achieve threadable attachment to the hollow tube. The bobeche and candle cup are provided with central holes dimensioned to fit loosely over a threaded end of the hollow tube. The bobeche and candle cup are rigidly attached to the construction by being placed over the threaded end of the hollow tube and compressed between a nut on the electrical socket and some form of nut, shoulder, stop or enlargement mounted on the hollow tube at the threaded end. In shoft, the bobeche and candle cup have been affixed between the electric socket itself and an abutment mounted on the holloww tube. The electric socket bears against and supports the bobeche and candle cup.

The foregoing prior art construction is structurally adequate to rigidly hold the bobeche and candle cup while the product is in use. However, the fixture as assembled is quite exposed to denting along the edge of the bobeche and to other forms of mechanical damage, especially during shipping. The light fixture construction also requires a great deal of space to pack because the widest portion, namely the bobeche, must be accommodated.

Should the need arise to change the bobeche or candle cup of the foregoing construction, for example, to change styles or to replace a damaged bobeche, the electrical socket must be removed. Inasmuch as the bobeche and candle cup are attached immediately under the bulb socket and the bulb socket is usually threadably affixed, either the wires must be disconnected from the bulb socket or the wires must be twisted, often incurring damage, in unthreading the bulb socket. To avoid twisting, the traditional candle-holder-simulating bobeche and candle cup light fixture has been supplied as a unit, and has been a problem for suppliers and shippers. These structures are in great demand, but they have been unnecessarily expensive.

Examples of the traditional means of affixing a bobeche and candle cup between threadable light sockets and stops such as nuts or shoulders are shown, for example, in U.S. Pat. No. 1,159,042—Kahns, 2,278,433—Elting, and others.

The prior art has attempted to resolve difficulties with the mounting or shipping of bobeches and candle cups according to various means. In U.S. Pat. No. 1,962,421—Boye, the bobeche has been reduced in diameter until virtually entirely omitted. U.S. Pat. No. 3,387,129—Weber et al and 4,034,216—Webster et al teach devices in which a one-piece decorative construction defining both a bobeche and candle cup is press fit on a grooved free end of a light fixture. Of course, such ease of attachment carries a corresponding ease of dislodgement. Both devices are snap-locked over detents and must be comprised of plastic resilient material.

In U.S. Pat. No. 3,719,820—Yarmark, an attempt is made to resolve the problem by use of a bulb socket which has a non-threadable wire-terminating portion slidably-attached to a threadable tube-engaging portion. According to the traditional means, the threadable portion of the bulb socket may be used as a nut to attach a bobeche and candle cup to the tube defining a light fixture arm. Should it become necessary to remove the bobeche and candle cup after the device has been assembled, for example at the factory, the user of Yarmark can disengage the wire terminating electric socket portion, and unthread the threadable portion without twisting the electrical wires. The drawback is that the electric socket comprises two separable parts.

The prior art has conceived of collapsing light fixtures into sub-elements for shipment. In some designs, the radiating tubes of a fixture are easily removed from the central body. In other designs, the legs may be rotated around the central body to rest against one another. These designs aggravate the need to protect the bobeche from damage.

Although the prior art has conceived of various means to mount bobeches and candle cups, the art has failed to provide a traditional appearing construction in which the electrical mechanism could be permanently factory assembled, and the bobeche and candle cup separately packaged, easily exchanged if damaged, and still capable of full structural engagement at the end of the light fixture arm. According to the invention, this is accomplished by use of a shouldered connecting flange which is placed on the light fixture arm, and provides a threadably-engageable cylindrical portion of a diameter greater than the electrical socket. The candle cup, and/or both the bobeche and candle cup, are provided with a large opening that engages the connecting flange, and may be easily placed over the electrical socket without unwiring the socket or damaging the wires by twisting the socket. According to the invention, permanent factory installation need only include the placement of the connecting flange and the wiring of the electrical socket. The possibility of damage to the bobeche and candle cup are reduced. The wholesaler and retailer experience less loss from dents and such, and may stock light fixtures having standardized hollow tube arms but interchangeable customized bobeches and candle cups. The retailer can supply any of a variety of bobeches and candle cups at the buyer's order. The invention thus provides a number of advantages over the prior art, using a relatively inexpensive structure according to a certain means of connection in the hollow arm.

SUMMARY OF THE INVENTION

It is an object of the invention to provide a candle-simulating electrical light fixture in which elements are easily removable without disconnecting electrical fittings, and yet are structurally sound.

It is an object of the invention to permit the removal of a bobeche and candle cup from an electrical light fixture adapted to simulate a candle holder, without disturbing the electrical fixture.

It is another object of the invention to prevent damage to exposed decorative portion of light fixtures.

It is yet another object of the invention to allow light fixtures to be processed or shipped in compact knocked-down condition, and assembled to order.

It is still another object of the invention to provide a removable decorative structure for an electrical light fixture simulating a candle holder, that is inexpensive, attractive and structurally sound.

These and other objects are accomplished by an electric light fixture of a type simulating a candle holder having a bobeche and candle cup which may be affixed or removed over an electrical socket without removing the socket, facilitating assembly and storage, and allowing interchangeable choice of bobeche and candle cup designs. A connecting flange mounted immediately adjacent the electric socket support has an external threaded portion of a diameter larger than the bulb socket. At least one of the bobeche and candle cup has a split flange forming the female thread for engaging the connecting flange.

BRIEF DESCRIPTION OF THE DRAWINGS

There are shown in the drawings the embodiments which are presently preferred. It should be understood, however, that the invention is not limited to the precise arrangements and instrumentalities shown in the drawings, wherein:

FIG. 1 is an exploded perspective view of the apparatus of the invention.

FIG. 2 is a perspective view of the permanently-installed electrical fixture, connecting flange and fixture arm.

FIG. 3 is a perspective view of an assembled fixture according to the invention.

DETAILED DESCRIPTION OF THE PREFERRED EMBODIMENTS

Figure 6:
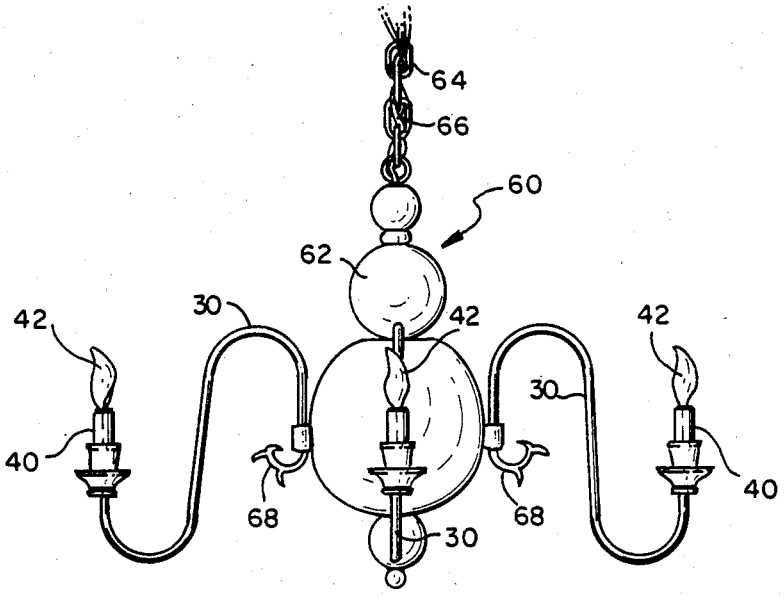
FIG. 6 is an elevation view of a chandelier including the light fixture assembly of the invention.

A light fixture assembly according to the invention may be advantageously employed on standing lamps, wall-fixtures or various other light fixtures. The device is especially adapted for use in chandeliers, a plurality of radiating arms or grouped radiating arms each supporting at least one light bulb. A supported light bulb, as shown in FIG. 3 and 6, may itself be adapted to simulate a flame. In any event, the overall structure is intended to imitate a traditional candle in a candle holder. Bulb 42 is intended to appear like a flame; bulb socket assembly 40 appears like body of a candle; and, a candle cup 48 and bobeche 46 form a candle holder supporting the candle. Of course, there is no need to catch drips of wax, or to support the already-threaded-on electric light socket. Nevertheless, traditional appearance is highly valued and the traditional appearance of a bobeche and candle cup are in great demand among consumers.

A hollow supporting arm 30, which may be a simple tube, or may include decorative elements 68, carries electric wires 32 from a source of electric power to the bulb socket 44. Wires 32 can be made especially durable, and can be adapted if necessary to resist damage when twisted. For example, the wires could employ braided conductors enclosed in strong insulation. According to the invention, however, the wires 32 will never be twisted, and can therefore be safely provided as less-expensive solid conductors having less durable and less expensive insulation.

Bulb socket 44 is preferably permanently wired and installed at the factory, and need not be removed unless a new bulb socket is to be installed (in which event the wires must be cut anyway). The wires 32 are passed through hollow tube 30 prior to their attachment to bulb socket 44. The remaining elements are affixed only to shouldered connecting flange 50, mounted immediately below bulb socket 44, and are not dependent upon bulb socket 44 for any part of their structural support. Connecting flange 50 may be press-fit over the free end of hollow tube 30 or may be threadably attached in the same manner as bulb socket 44.

Figure 4:
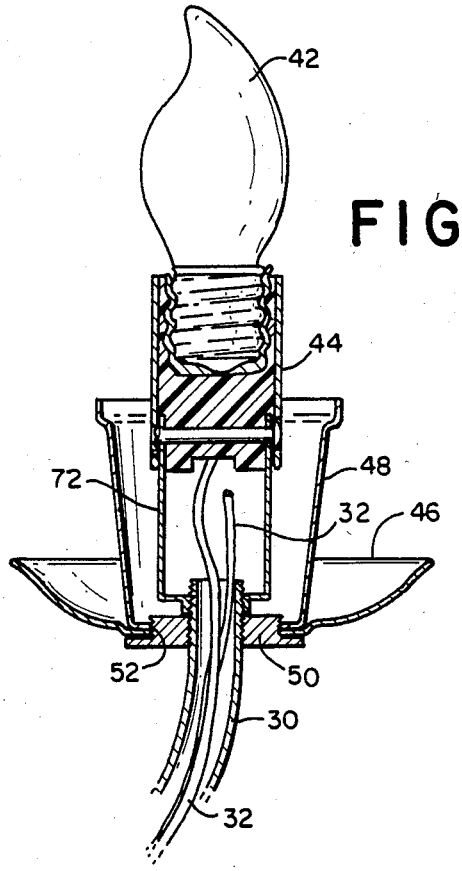
FIG. 4 is a section view taken along lines 4—4 in FIG. 3.

Bulb socket 44 may be a short cylinder, as shown in FIG. 3, or may be longer, more reminiscent of a candle body, as shown in FIG. 6, and to some extent, in FIG. 4. It will be appreciated that the invention is applicable to various enclosures around the electric socket of the fixture, the electric socket being free of the enclosure in structure and function. The electric socket rather than the decorative enclosure is the element sensitive to twisting. The decorative features, on the other hand, are sensitive to damage from denting and the like. The decorative elements which extend horizontally from the axis of hollow tube 30, expecially bobeche 46, benefit from the invention by being removable during shipping and thus protected from dents. Furthermore, the removal of these elements allows the fixture to be tightly packed.

The bobeche rather than the candle cup could conceivably be the cup element which is attached to the connecting flange 50, and removable over the electrical fixture. In such a construction, the candle cup 48 could be a small-diameter apparatus and bobeche 46 dimensioned to fit over the cup 48 and also over electric fixture 44. Electric fixture 44 is preferably shielded by an insulating element, for example, sleeve 78.

Referring to FIGS. 2 and 4, the conventional bulb socket 44 includes an electrical connection 74, which may include screws, but is more frequently a rivet or solder connection, and is not easily removed. Even if screws are used, it is advisable not to disturb the factory connections, and to thereby risk a short circuit, possible fire and the like.

Bulb socket 44 includes support structure 72 in the form of a pair of metal leg elements terminating in an integrally formed internally-threaded nut member 76 which threads over the end of hollow tube 30. Connecting flange 50, which may be press-fit over tube 30 or threadably attached thereto, abuts nuts 76 of supporting structure 72, which in turn carries the bulb socket 44.

Connecting flange 50 matches bobeche 44, for example, a brass or brass-plated sheet metal element of appearance similar to candle cup 48. Of course, there are a number of variations, including pewter, silver, gold and the like. These elements may also be cast rather than formed from sheet.

Connecting flange 50 is threaded only alolng the smaller-diameter upper portion 52 thereof. A shoulder-forming stop portion 54, defined by the larger diameter lower portion of flange 50, provides the opposed support which bears upwards against the downward force of threadably-affixed candle cup 48.

Figure 5:
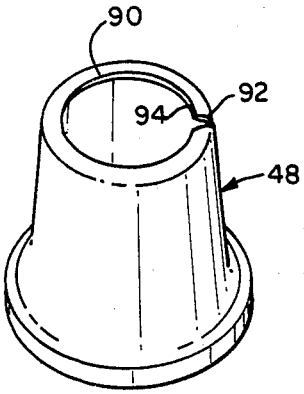
FIG. 5 is a perspective view of a candle cup according to the invention, shown upside-down.

The structure of candle cup 48 is shown in FIG. 5. A large opening 90, dimensioned wide enough to fit easily over bulb socket 44 and any sleeve thereupon, is provided in the bottom part of candle cup 48. The candle cup is, of course, shown upside-down in FIG. 5.

Candle cup 48 may be made of sufficiently thick material that a thread could be molded or machined on the edge of in the opening 90. It is preferred that candle cup 48 be made of sheet metal. A thread can be adequately formed in opening 50 by means of a split flange construction wherein one or more short radial slots 92 is formed in the turned-in edge formed in the bottom portion of candle cup 48. One edge 94 of slot 92 is raised slightly from the other edge, defining a pitch to the thread, which pitch is made to correspond to the pitch of the thread machined or molded in the smaller-diameter part of connecting flange 50.

Bobeche 46 preferably has an opening slightly larger than that of the candle cup, and may be axially slided over the thread portion 52 of connecting flange 50. Bobeche 46 need not be threaded if a thread engaging structure is formed on candle cup 48, because the candle cup will bear against the bobeche, the bobeche being held between the bottom of the candle cup and shoulder 54 on connecting flange 50.

The overall structure is well suited for use on chandeliers 60, as shown in FIG. 6. Chandeliers are typically centrally supported, for example, on chains 64 or the like, and electrically connected to a source of power by means of wires 66 which pass through a central body 62. The central body forms a junction box, and also supports each of the hollow tubes 30, upon which the bulb sockets and associated elements are affixed to radiate from the central body.

The invention having been disclosed, a number of variations will now occur to person skilled in the art. Therefore, references should be made to the appended claims rather than the foregoing specification as indicating the true scope of the invention.

What is claimed is:

1. A light fixture, comprising:

a tubular support enclosing an electric wire for carrying current to a light bulb, the light bulb to be mounted in a socket at a free end of the support, the support having means to engage the socket at said free end;

a connecting flange attached to the tubular support adjacent the free end, the flange being wider than the socket, the flange having a stepwise increase in diameter forming a shoulder, a smaller portion of said connecting flange being threaded and a larger portion defining a stop;

a cover cup mounted to at least partly surround the socket, the cup having an opening in the bottom thereof dimensioned to fit over the socket and engage the connecting flange; and, at least one additional cup having an opening in a bottom thereof, said opening in the bottom of the additional cup being larger than the threaded portion of the connecting flange, the additional cup being held between said cover cup and the stop, whereby the cover cup and the additional cup can be mounted and removed without disturbing the light bulb socket.

2. The light fixture of claim 1, wherein the cup is formed of sheet metal and has a split flange at the opening of the bottom thereof, the split flange being threadable over the connecting flange.

3. The light fixture of claiam 1, wherein the cover cup is a candle cup and the additional cup is a bobeche.

4. The light fixture of claim 1, wherein the tubular support is externally threaded for connection to internal threads on the socket and the connecting flange.

5. A light fixture for simulating a candle in a candle holder, comprising:

a hollow tube having a threaded free end;

a socket for holding a lightbulb, affixed to the free end of the hollow tube, the socket being connected to electric wires extending into the hollow tube, the bulb socket being threadably attached to the hollow tube;

a connecting flange attached to the hollow tube immediately adjacent the socket, the connecting flange having an external threaded portion wider than the socket;

a bobeche having an opening dimensioned to fit over the external threaded portion of the connecting flange; and, a candle cup having an opening in a bottom thereof fitting over the socket, the candle cup being threadable on the flange and the candle cup rigidly holding the bobeche against the flange, whereby the bobeche and candle cup are removable without disconnecting the electrical wires from the socket.

6. The light fixture of claim 5, further comprising at least one alternate bobeche and candle cup.

* * * * *